US006176757B1

(12) United States Patent
Lin

(10) Patent No.: US 6,176,757 B1
(45) Date of Patent: Jan. 23, 2001

(54) TOY BRICK GAME

(76) Inventor: Tung-Shao Lin, No. 16, Lane 67, Tai-Ming Rd., Wu-Jih Hsiang, Taichung Hsien (TW)

( * ) Notice: Under 35 U.S.C. 154(b), the term of this patent shall be extended for 0 days.

(21) Appl. No.: 09/433,014

(22) Filed: Nov. 3, 1999

(51) Int. Cl.[7] ..... A63H 33/08

(52) U.S. Cl. ..... 446/115; 446/108; 446/111; 446/112; 446/104; 446/102

(58) Field of Search ..... 273/155, 156, 273/157 R; 446/102, 104, 108, 109, 111, 112, 114, 115; 160/218, 220, 229.1, 210, 213; 40/733

(56) References Cited

U.S. PATENT DOCUMENTS 1,121,756 * 12/1914 Patton ..... 160/220
4,685,892 * 8/1987 Gould et al. ..... 446/109
5,545,070 * 8/1996 Liu ..... 446/104
5,715,854 * 2/1998 Andrieux et al. ..... 446/108 X
5,895,045 * 4/1999 Vilar ..... 446/115 X
5,897,417 * 4/1999 Grey ..... 446/102 X
6,089,941 * 7/2000 Glickman et al. ..... 446/111

* cited by examiner

*Primary Examiner*—Raleigh W. Chiu
(74) *Attorney, Agent, or Firm*—Fei-Fei Chao; Venable, Baetjer, Howard & Civiletti, LLP

(57) ABSTRACT

The invention discloses a toy brick game having at least two toy bricks and at least one connector for connecting the above at least two toy bricks together. The toy bricks can be one of a variety of geometrical shapes but have at least three side edges. Each side edge has a notch and two cylindrical stubs formed on the surface defining the notch. The connector can connect two or more toy bricks together by engaging a slit defined in a pole thereof with the cylindrical stub. The engagement is not only easily achieved and strong enough to allow robust models to be constructed, it also allows one toy brick to be able to rotate in two directions with respect to another toy brick connected thereto by the connector thus providing the user interest and pleasure.

1 Claim, 6 Drawing Sheets

TOY BRICK GAME

BACKGROUND OF THE INVENTION

1. Field of the Invention

The invention relates to toy brick games favored by children, especially to the toy bricks which are able to be securely connected with each other and rotate in two directions with respect to each other, and which can bring a lot of interest for the children playing with them.

2. Description of Related Art

Toy brick games are favored by children all over the world. They a very good kind of toy that can be used to improve children's intelligence and patience.

A typical kind of conventional toy brick game is as shown in FIG. 7. Square toy bricks (60) are provided, and in each side of each of which a notch (61) is defined. In most situations the notch (61) has a flat bottom plane and two opposite side planes being perpendicular to the bottom plane. Two substantially semispherical small protrusions (63) are respectively formed on the two side planes. A pole connector (50) is provided for connecting two toy bricks (60) together. Each pole connector (50) has two flat top planes on each of which two dimples (52) are formed side by side. Pushing the pole connector (50) into the notch (61) until the dimples (52) engage with the small protrusions (63) can then connect two toy bricks (60).

However, this kind of toy brick game has the following shortcomings:

1. inconvenience in assembly: the volumes of both the protrusions (63) and the dimples (52) are very small, and to align them accurately is not only inconvenient, it also may be boring to a child;

2. insufficient combination force: the small volume and thus the small contacting area determine that the combination forces maybe insufficient to make a strong and large structure, especially to a child, because the accuracy of his/her actions is not very high;

3. only one rotational direction is possible thus resulting in fewer assembly variations: obviously, one toy brick is only able to rotate with respect to another in one rotational direction.

SUMMARY OF THE INVENTION

The main objective of the invention is to provide a kind of toy brick game of which two bricks can be connected allowing one to be able to rotate with respect to the other in two rotational directions.

Another objective of the invention is to provide a kind of toy brick game of which two bricks can be connected by simple action and which achieve great combination force.

THE REFERENCE NUMBERS

10. connector, 11, 111. pole,
13. slit, 15. through hole,
16. pivot;
30. toy brick,
31. notch, 33. cylindrical stub;
50. pole connector,
52. dimple;
60. toy brick, 61. notch,
63. small protrusion.

DETAILED DESCRIPTION OF THE PREFERRED EMBODIMENT

Figure 1:
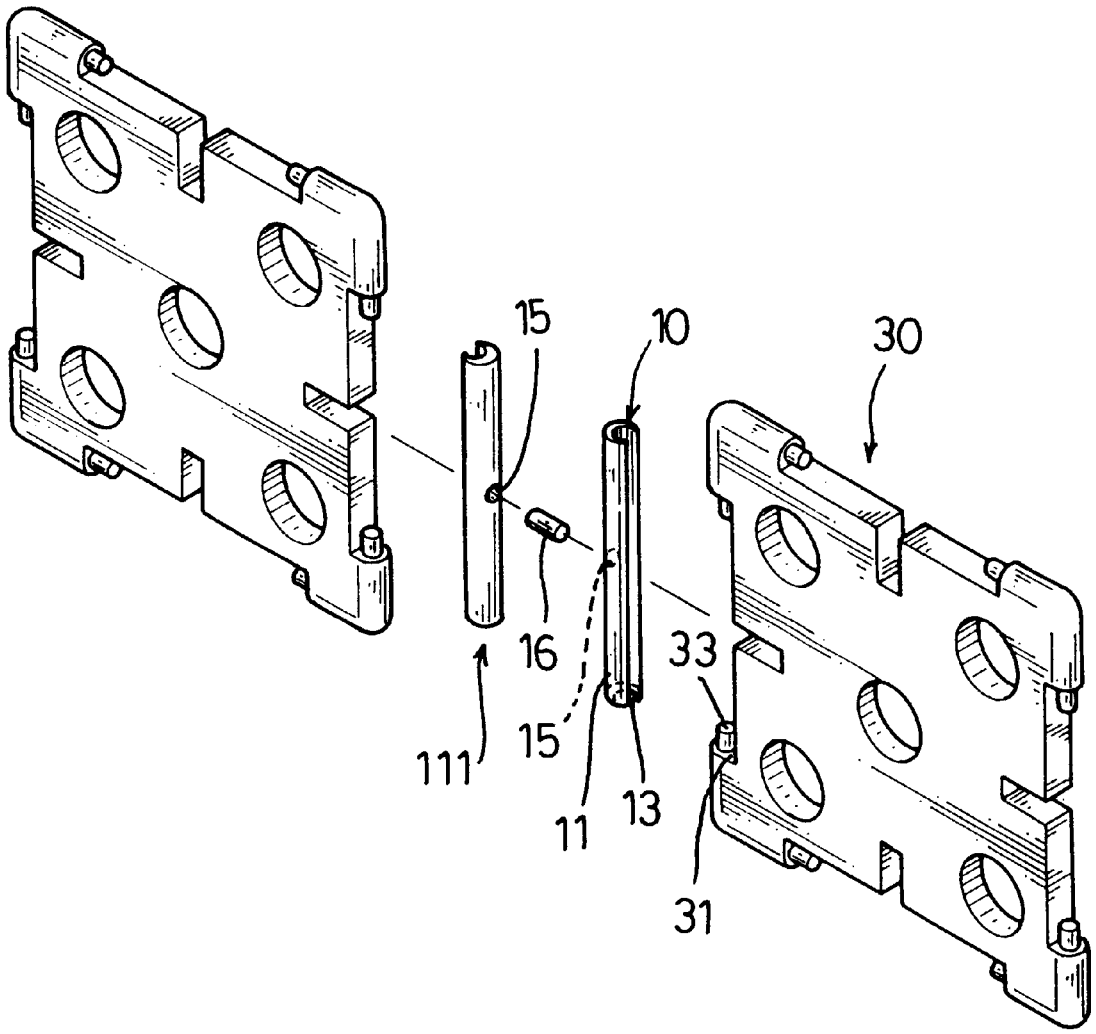
FIG. 1 is an exploded perspective view of the invention.

As shown in FIG. 1, a toy brick game of the invention has two constituent parts: at least two toy bricks (30) and at least one connector (10) for connecting the above at least two toy bricks (30) together.

Each toy brick (30) can be one of a variety of geometrical shapes and has at least three side edges, each of which has a notch (31) defined therein. The notch (31) has a flat bottom plane and two opposite side planes being perpendicular to the bottom plane. Two cylindrical stubs (33) are respectively formed on the two side planes and extend parallel to the flat bottom.

Each connector (10) is made up of two identical poles (11, 111) made of elastic material, and a pivot (16) securely but pivotally extended through two through holes (15) defined at the middle of each pole (11, 111) and being perpendicular to the axis of each pole (11, 111) respectively. The two poles (11, 111) are positioned substantially side by side but are able to rotate with respect to each other after being connected by the pivot (16), as shown in FIG. 3.

Figure 3:
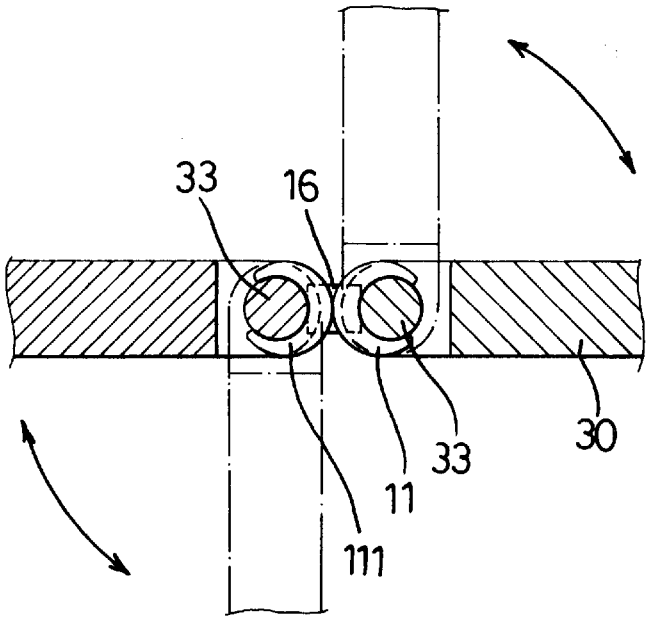
FIG. 3 is a cross-sectional view of the invention.

Still with reference to FIG. 3, since the two poles (11, 111) are identical, only one is selected herein as an example. The pole (11) is round in cross-section when viewed from an end face and has a slit (13) extending along its entire length and defined perpendicular to the through hole (15). A cross-sectional view from an end of the slit (13) shows a sector of a circle greater than 180°. This circle meets the periphery of the pole (11) at two points and therefore forms two identical arms (131, 132). The distance between these two points is smaller than the diameter of the circle, which is substantially equal to the diameter of the cylindrical stub (33).

Figure 2:
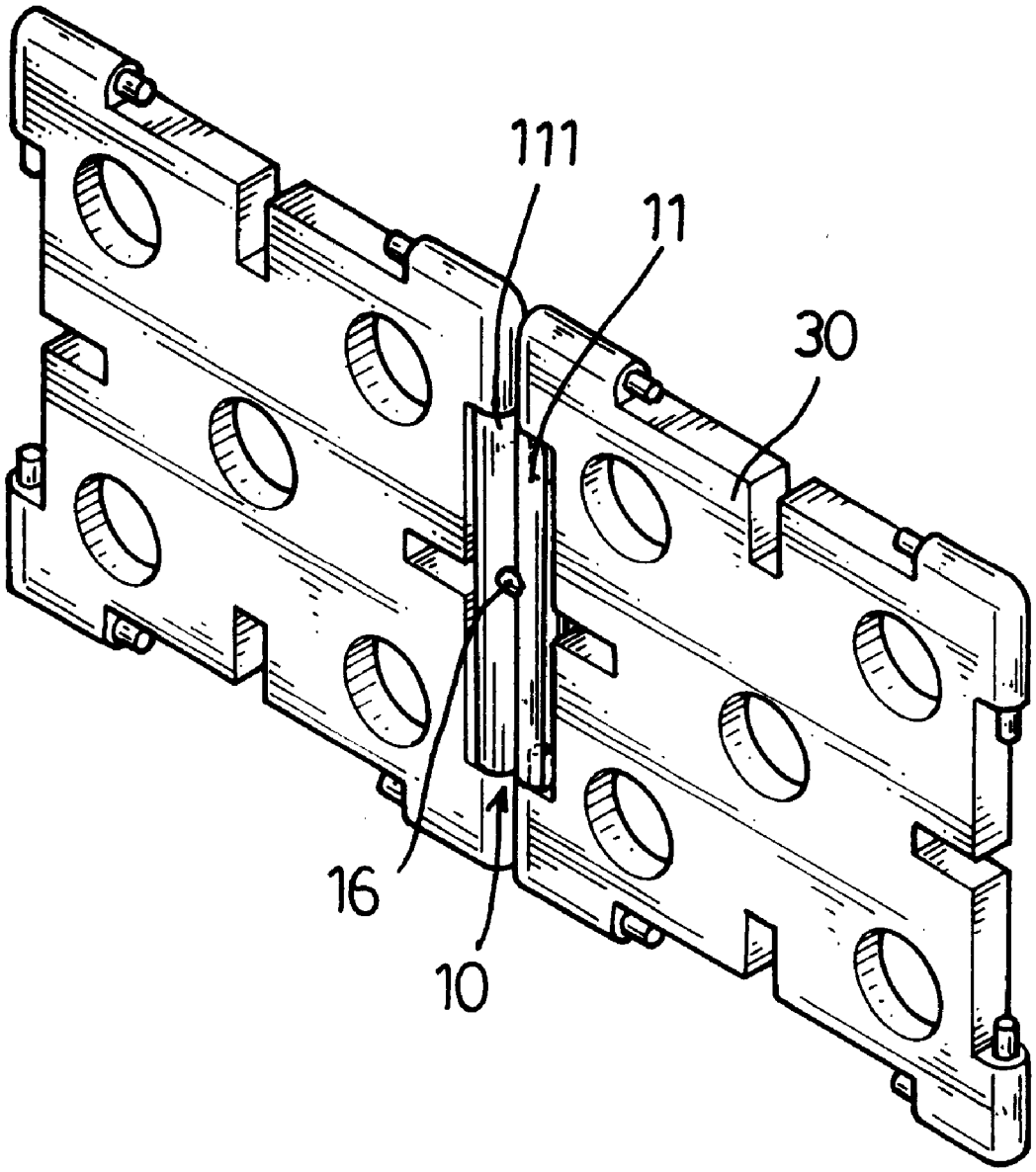
FIG. 2 is a perspective view of the invention showing two toy bricks combined.

In assembly, a user can first align the slit (13) of the connector (10) with the cylindrical stub (33) of one of the toy bricks (30) and push the connector (10) towards the notch (31). Since the diameter of the cylindrical stub (33) is a little greater than the distance between the aforementioned two points and since the connector (10) itself is elastic, the cylindrical stub (33) will push the two arms (131, 132) apart at the beginning and then is enclosed there by the two reinstated arms (131, 132) when it is finally pushed into the slit (13). In a similar way, the user can set up any desired structure by connecting more toy bricks (30) together with the connectors (10). FIG. 2 is a schematic view showing two of the toy bricks (30) combined together by one of the connectors (10).

Figure 4:
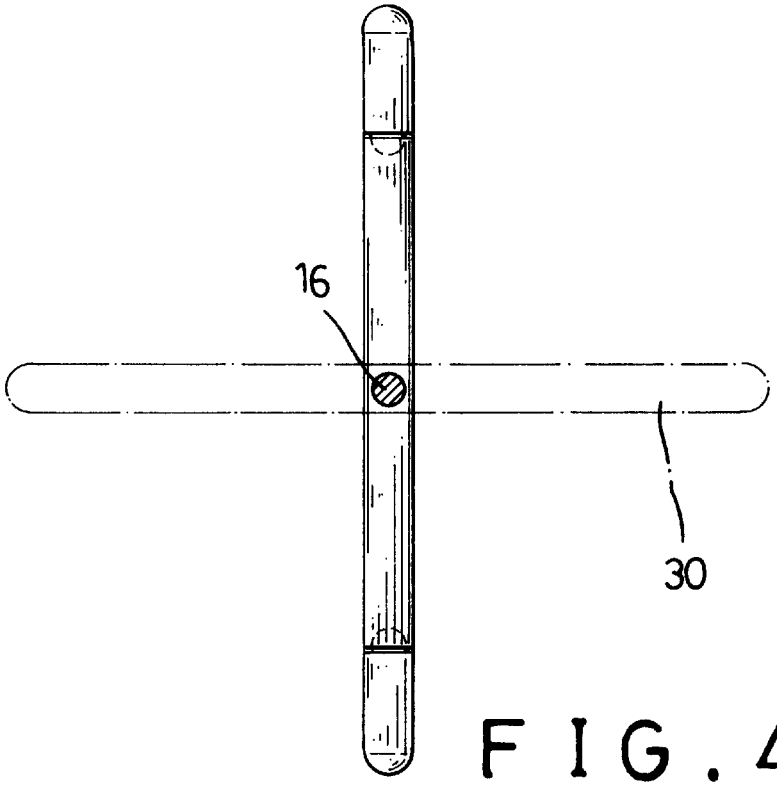
FIG. 4 is a partial cross-sectional view of the invention showing the rotation of the toy brick.
Figure 5:
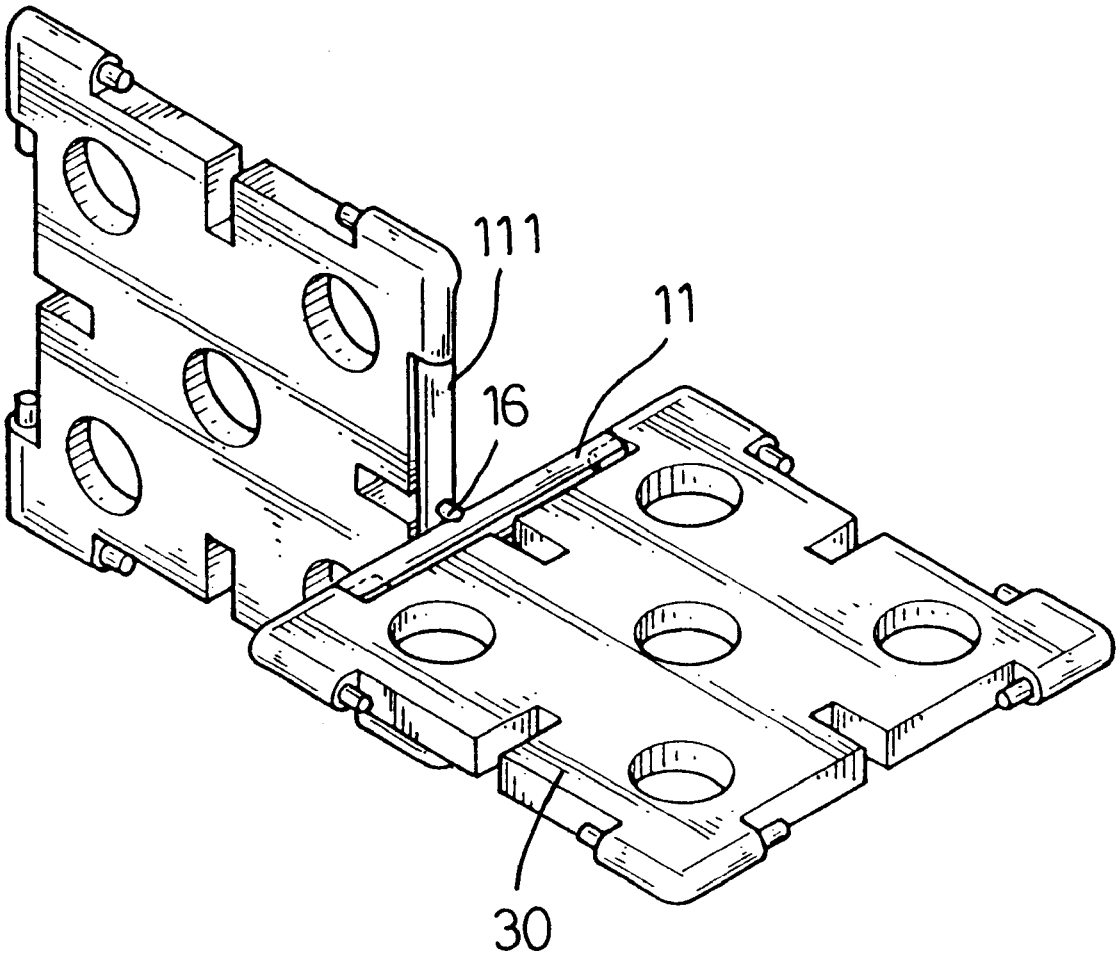
FIG. 5 is a perspective view of the invention showing the rotation of the toy brick.

As shown in FIGS. 4 and 5, one of the toy bricks (30) is able to rotate with respect to another by pivoting about the pivot (16).

Figure 6:
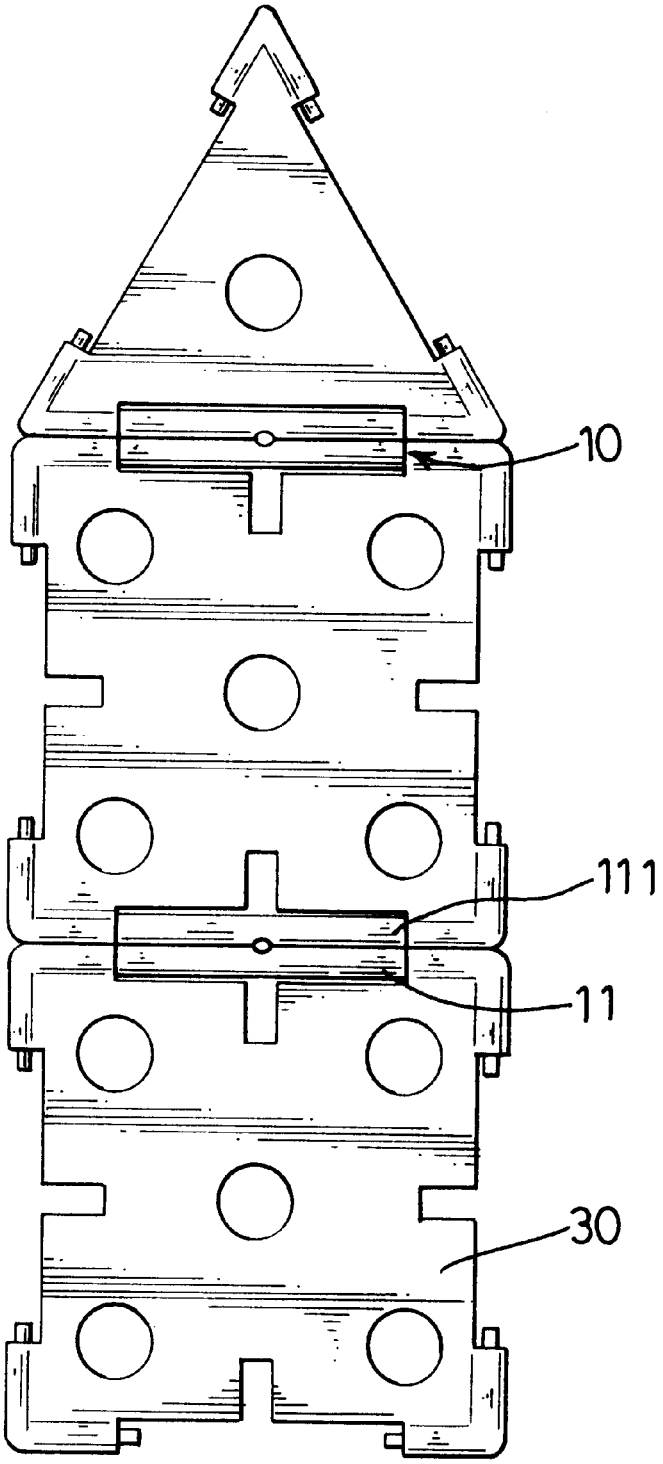
FIG. 6 is a plane view showing another embodiment of the invention.
Figure 7:
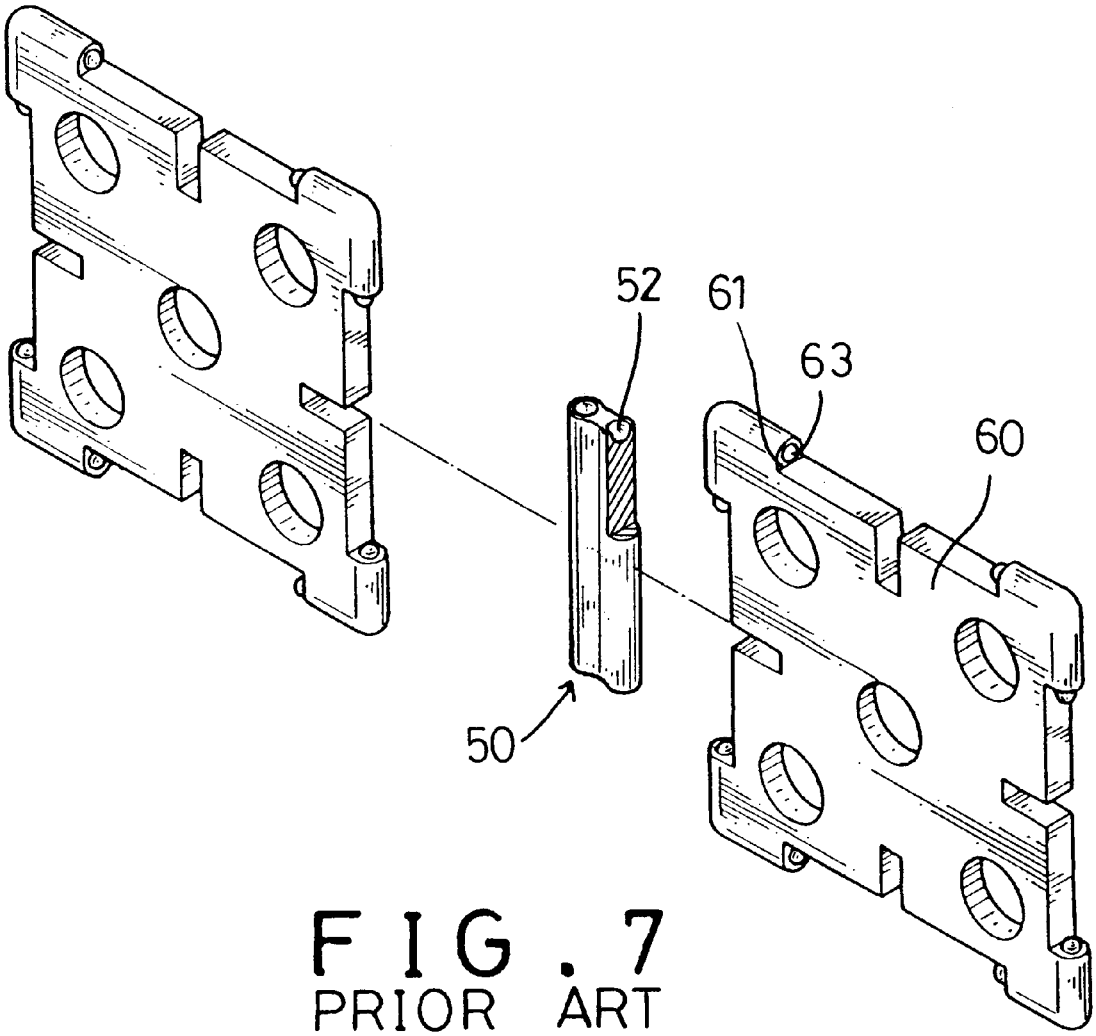
FIG. 7 PRIOR ART
FIG. 7 is an exploded perspective view of a conventional kind of toy brick.

In the above embodiment, all the toy bricks (30) are square when viewed from a front face. However, as mentioned hereinbefore, the toy bricks (30) can be one of a variety of geometrical shapes, such as rectangles, triangles, and so on. Shown in FIG. 6 is another embodiment showing an assembly built up by using two square toy bricks (30) and a triangular toy brick (30).

From all above description, it could be seen that the toy brick (30) of the present invention has the following advantages:

1. one toy brick (30) is able to rotate in two directions with respect to another brick (30) connected thereto and thus introduces many variations in construction and interest in play;

2. the engagement between the slit and the cylindrical stub is easy to achieve yet strong enough to enable robust models to be constructed therewith.

What is claimed is:

1. A toy brick game comprising:

at least two toy bricks (30), each toy brick (30) having at least three side edges, each of which has a notch (31) defined therein, the notch (31) having a flat bottom plane and two opposite side planes being perpendicular to the bottom plane, two cylindrical stubs (33) respectively formed on the two side planes and extending parallel to the flat bottom; and, at least one connector (10), each connector (10) comprising two identical poles (11, 111) made of elastic material, and a pivot (16) securely but pivotally received in two through holes (15) respectively defined in the middle of each pole (11, 111) and being perpendicular to the longitudinal axis of each pole (11, 111) respectively, said two poles (11, 111) being substantially side by side but being able to rotate with respect to each other after being connected by the pivot (16).

* * * * *